United States Patent [19]

von Schuckmann

[11] 4,402,425

[45] Sep. 6, 1983

[54] CONTAINER FOR THE DISPENSING OF INDIVIDUAL TABLETS

[76] Inventor: Alfred von Schuckmann, Kervendonk 63, 4178 Kevelaer 2, Fed. Rep. of Germany

[21] Appl. No.: 158,175

[22] Filed: Jun. 10, 1980

[30] Foreign Application Priority Data

Jun. 23, 1979 [DE] Fed. Rep. of Germany ..... 2925432
May 10, 1980 [DE] Fed. Rep. of Germany ..... 3018041

[51] Int. Cl.[3] ..... B65G 59/06
[52] U.S. Cl. ..... 221/202; 221/298
[58] Field of Search ..... 221/202, 264, 251, 200, 221/293, 299, 298

[56] References Cited

U.S. PATENT DOCUMENTS 2,714,973 8/1980 Meyer ..... 221/202 X
4,230,236 10/1980 Boulter ..... 221/264 X

*Primary Examiner*—Stanley H. Tollberg
*Attorney, Agent, or Firm*—Martin A. Farber

[57] ABSTRACT

A container for the dispensing of tablets one by one in which a tablet drop-out opening is provided in the wall of the container below a storage chamber, a spring-loaded slide traveling in front of the region of the opening and releasing in each case one of the tablets so that it can drop out, the slide having associated with it a division finger which, in the depressed position of the slide which is continued towards the outside by an actuating button, blocks the path between the bottom opening of the storage chamber and the tablet drop-out opening. The slide forms in the region of the inner throat of two container bottom walls which are inclined in V shape to each other, a side wall which in the basic position of the slide protrudes over the throat and carries a side rib which is directed transversely relative to the inclination of the container bottom walls downwardly to a tablet drop-out opening of the slide, the side rib having a passage opening for the division finger opposite to which division finger there is a deflection shoulder of the slide, the shoulder extending approximately to the tablet drop-out opening.

18 Claims, 13 Drawing Figures

Figure 4:
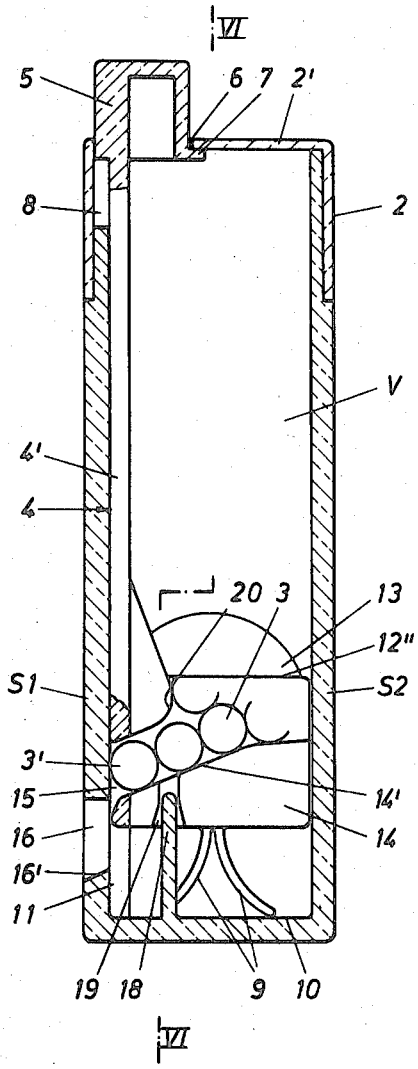

FIG. 1
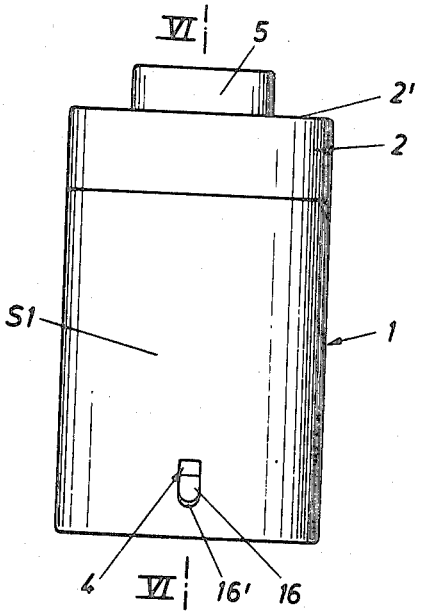
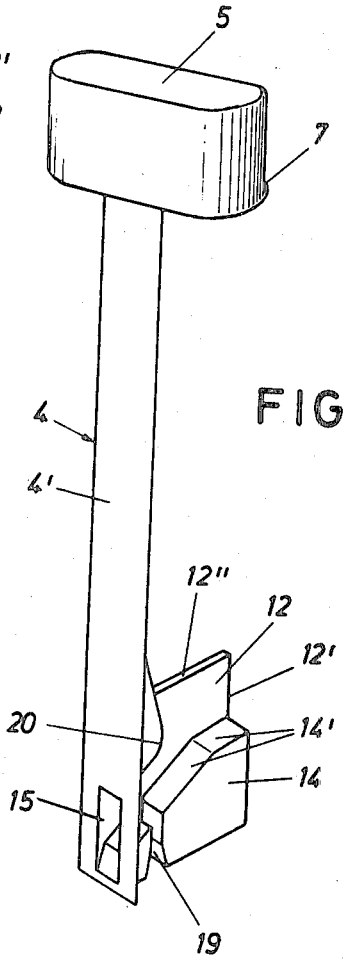
FIG. 3
FIG. 2
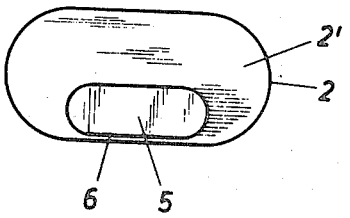

CONTAINER FOR THE DISPENSING OF INDIVIDUAL TABLETS

The present invention relates to a container for the dispensing of individual tablets one by one in which a tablet drop-out opening is provided in the wall of the container below a storage chamber, a spring-loaded slide traveling in front of the region of the opening and releasing in each case one of the tablets so that it can drop out, the slide having associated with it a division finger which, in the depressed position of the slide which is continued towards the outside by an actuating button, blocks the path between the bottom opening of the storage chamber and the tablet drop-out opening.

A container of this type is known from U.S. Pat. No. 892,569. The division finger extends in the manner of a bulkhead below the bottom opening of the storage chamber so that the rest of the contents are separated from the piece which is ready to drop out. The opening of the tablet drop-out opening takes place hand in hand with this displacement of the slide. The correspondingly opposite opening and closing functions are obtained in the manner that a flexible tab is fastened to the free end of the division finger, this tab being pulled over a deflection roller. The flexibility of this tab is so great that the restoring force can be utilized to secure the closed position of the slide. The division finger and closing tab lie at a distance from each other which corresponds to the diameter of a pill. The pills are of spherical shape. The dispenser in this case consists of a large number of individual parts. It is therefore relatively expensive to manufacture and assemble. In view of the substantial frictional forces, the closure tab must be of high resiliency. This results in more difficult operation as well as in the danger of tablets being crushed and it also leads to restriction in movement so that the critical intermediate-opening position cannot be sufficiently rapidly passed over. Therefore, more than one tablet can enter into the position of readiness for delivery, as a result of which the contents may possibly be damaged. Such a mechanism can also not be directly employed for tablets which are of disk shape or, as also present in the market, are of strongly lens-like shape. In particular such strongly bulging or lens-shaped tablets, due to the possibility of assuming an oblique position in adjusted state, even in a narrow delivery shaft adapted thereto, can tilt into a shingle-like overlapping position which leads to a self-locked jammed position which impairs the certainty of the delivery. This jamming effect is further increased when the balance of the contents rests thereon.

The object of the present invention is to develop a container of the above type for the delivery, one by one, of its contents, consisting of tablets, in a structural form which is technically simple to manufacture, dependable in operation, gentle in its action on the tablet and favorable in operation, in the manner that as a result of the displacement of the slide such an extensive loosening of the contents close to the bottom is effected that even a strong lens shape of the tablets cannot interfere with the individualizing of the tablets.

This object is aided in the manner that the slide (4) forms in the region of the inner throat (K) of two container bottom walls (13) which are inclined in shape to each other, a side wall (12) which in the basic position of the slide protrudes over the throat (K) and carries a side rib (14) which is directed transversely relative to the inclination of the container bottom walls (13) downwardly to a tablet drop-out opening (15) of the slide (4), the side rib having a passage opening (19) for the division finger (18) opposite to which division finger there is a deflection shoulder (20) of the slide (4), the shoulder extending approximately to the tablet drop-out opening (15).

As a result of this development, a container developed in the form of a so-called tablet dispenser which is of particularly high suitability for use is created. For this purpose, the slide which serves to form part of the tablet sluice is provided with a side wall which protrudes above the channel and retains the rest of the contents of the container within the region of one of the bottom walls of the container which extend in V-shape, so that no load which could produce a tilting of the tablets is produced from there. The material which rests on the other bottom surface of the container slides onto the side rib of the slide which forms the rolling ramp and from there in the direction towards the passage opening. The lowest tablet finally rests against the inside of the container wall. Upon the displacement of the slide which is effected for the release of the content the tablets slide along the shaft wall of the slide.

This contact already produces a certain loosening. With increasing descent of the side rib which bears the tablets, this rib comes into the range of the division finger, which effects a further loosening of the immediately adjacent practically pre-sorted balance of the content. The side rib has a corresponding passage opening for this division finger, opposite which there is a deflection shoulder of the slide which extends approximately up to the drop-out opening for the tablet. The dispensing is extremely gentle and free of shear forces. For moving along the contents it is advantageous for the upper edge of the side wall to be at the height of the throat in the inserted position of the slide. In this way the contents of the container can slide down and out also over the lowered side wall so that despite a certain dividing action the contents can be removed, down to the last tablet. One structurally advantageous solution consists furthermore in the fact that the actuating button for the slide extends with displacement, limited by a stop, out of an opening in the container lid and the tablet drop-out opening is located on the side wall of the container. This affords the possibility of using the container lid at the same time as a guiding and holding member for the slide. The excess length which extends beyond the lid and can easily be recognized as an operating button which provides encouragement at all times for proper operation. The tablet drop-out opening on the side wall of the container has the advantage in use that it is not necessary to hold the container, for instance above the coffee cup, in which case the downward falling tablet then causes splattering against the base of the container. Due to the fact that the slide furthermore travels over its entire length in a rail guide of one inner wall of the container, reciprocal stabilizing of these parts in particular is obtained. Even from the standpoint of injection molding a favorable structural form is present. Only a few parts are necessary, namely the container, lid and slide, particularly since the slide spring can, utilizing the resiliency of the material of the slide, be simultaneously developed thereon in the form of one or more tabs. In this respect there is the further advantageous development that the division finger extends from a section of the one bottom wall of the container which section is bent at an angle in the direction of movement of the slide. It is furthermore advantageous to arrange the slide spring in the region below the bottom walls of the container. In this way the spring does not come into contact with the contents.

In order to optimalize the conditions for the individualizing of the tablets, this going hand in hand with a further improvement in the guiding of the slide, in a further advantageous embodiment adjacent the division finger (18) on the side thereof facing away from the deflection shoulder (20) there is a second finger (26) which extends through a second passage opening (27) of the slide (4).

The slide which forms the tablet sluice gate is now, upon the lowering thereof, penetrated by two fingers, namely the division finger which serves more to form a barrier and the second finger which loosens up the following tablets. The distance between the fingers can be so selected that the next to the last tablet is lifted out of the row. This movement continues deeply staggered into the adjoining group of tablets The second finger furthermore also carries out the additional function of a further guiding of the slide, specifically in the region which is exposed to an increased filling load. From a structural standpoint it is favorable in this respect for a downward directed tab to extend from one edge of the passage opening for the first division finger which lies closest to the deflection shoulder, this tab resting against one side flank of the division finger, and for a second tab, directed at an acute angle to the first tab to extend from the passage opening for the second finger which is remote from the deflection shoulder, the second tab entering into the space between division finger and second finger and resting with its free end against one side flank of the second finger. The last tab is therefore so aligned, with the formation of a funnel-shaped passage opening for the division finger, that its free end at the same time forms a projection which additionally supports and respectively guides the slide. The corresponding tab also prevents broken pieces of tablets falling into the free space between the two fingers. A stabilizing of the slide is obtained in simple manner by the fact that the slide is developed in the form of a frame. The width of the frame can be so selected that guidance support can be obtained on the inner walls of the housing. A more favorably distributed load component is also obtained for the spring which urges the slide into its basic position. The slide springs, which can be directly formed on the frame, advantageously extend from the lower corners of the frame and therefore from regions which are in themselves already highly stabilized, and then, extending in arcuate shape towards each other rest against the bottom of the container which forms their abutment. Due to the lateral displacement, the slide springs can also be made relatively long thus resulting in a soft manner of actuation. A convenient dispensing operation is furthermore obtained by the fact that the outer end of the slide is developed as an actuating push-button which fills up the entire upper inside cross section of the storage chamber. This button in this connection assumes the function of the lid which closes off the top of the container. On the other hand a correspondingly larger opening cross section is available for the filling of the container. The filling time cycles can thereby be maintained extremely brief. The holding of the actuating push button on the inner wall of the storage container in which it is guided can be effected by detents. The detent interengagement of the guided and guiding parts is adjusted to the detent stroke. Finally, it may be favorable, particularly for technical reaons of injection molding, for the actuating push button to constitute a separate structural part and thus rest loosely on the upper end surface of the slide-frame arm present there.

Figure 5:
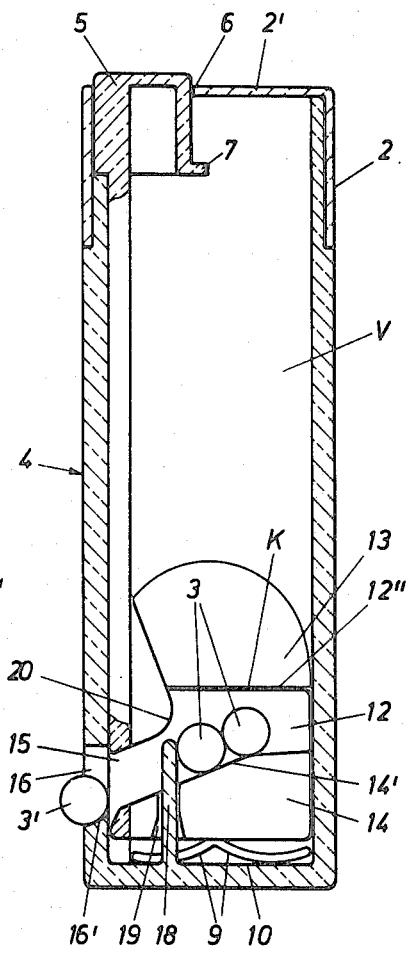
Figure 6:
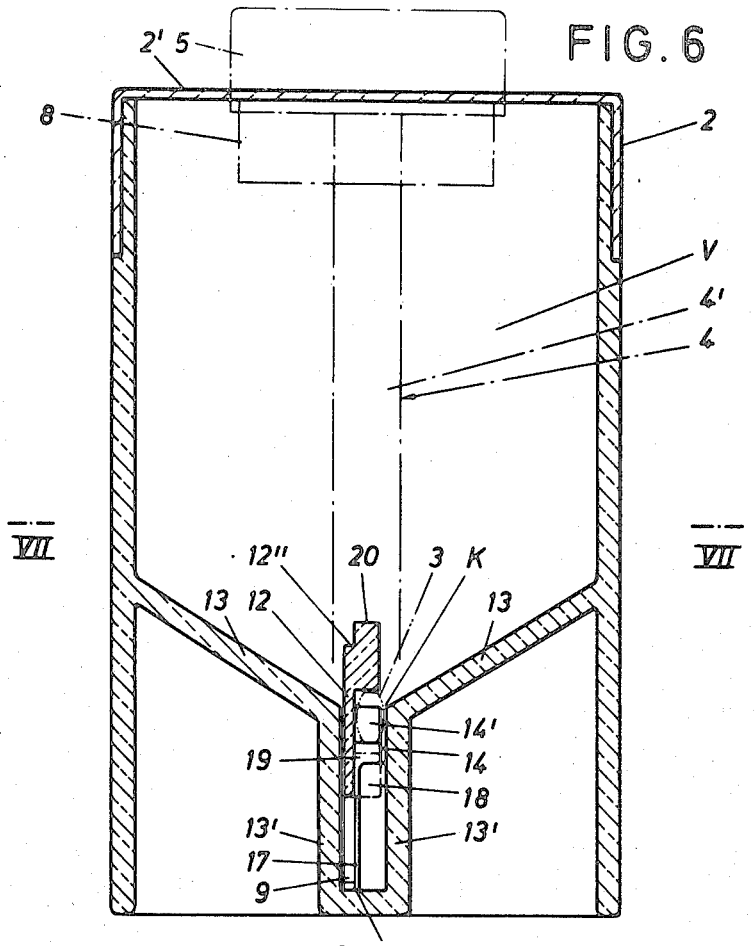
Figure 7:
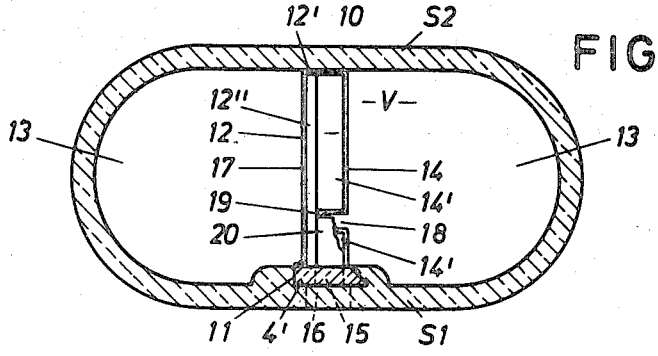
Figure 8:
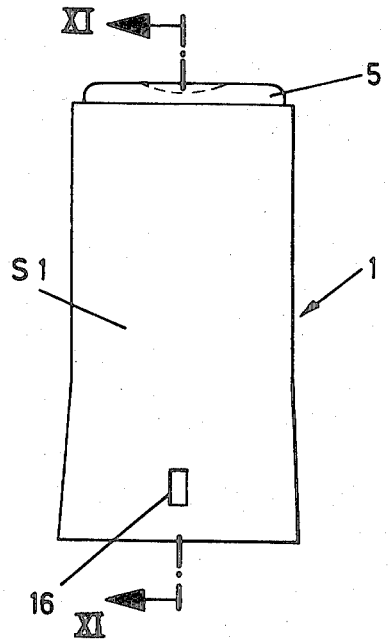
Figure 10:
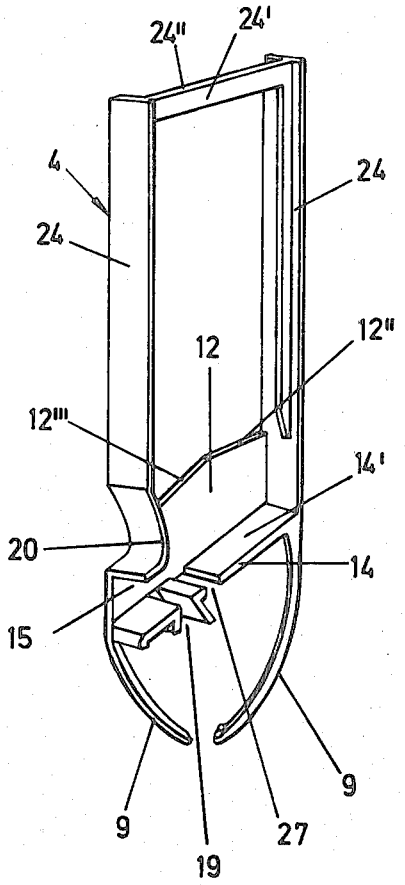
Figure 9:
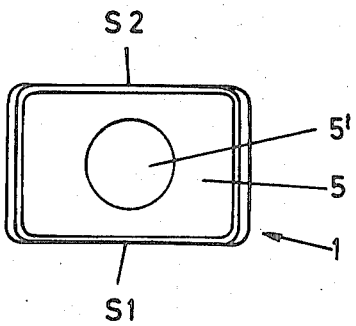
Figure 11:
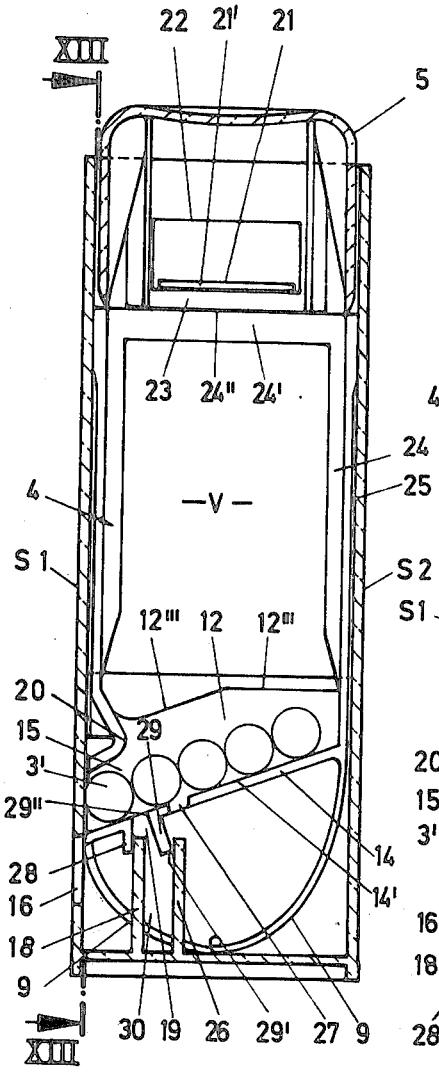
Figure 12:
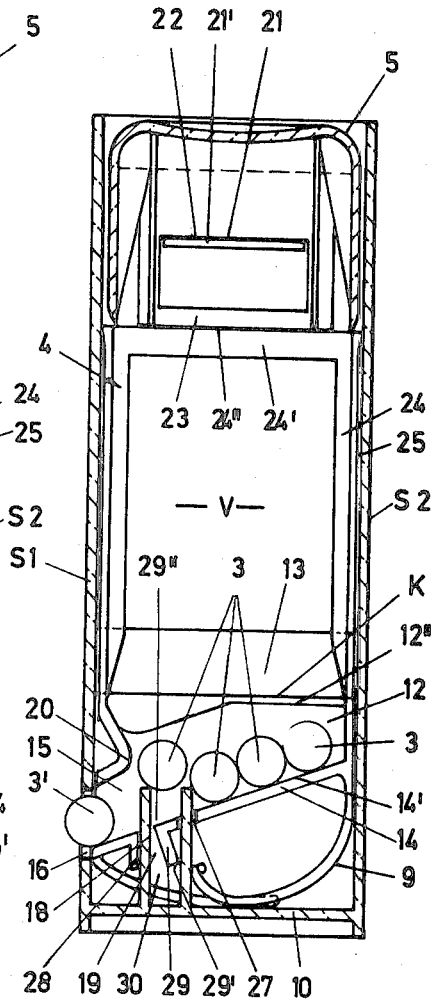
Figure 13:
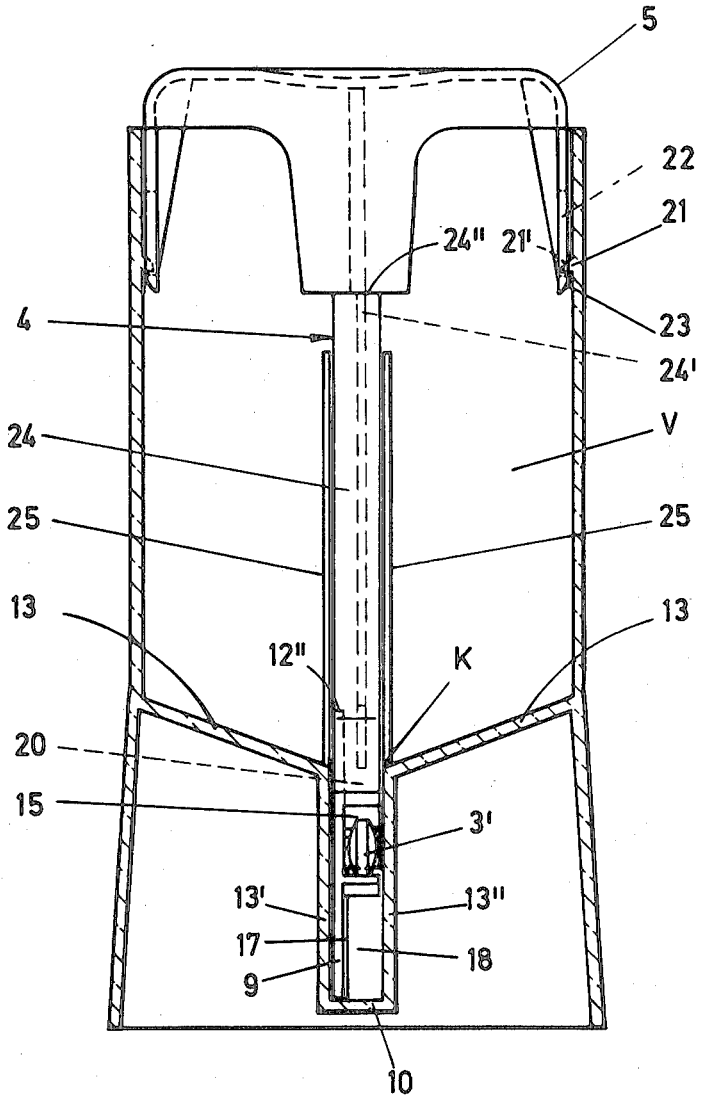

Other advantages and details of the subject matter of the invention will be explained below with reference to two illustrative embodiments shown in the drawing, in which:

FIG. 1 shows the container of the invention in accordance with the first embodiment, seen in front view, FIG. 2 is a corresponding top view, FIG. 3 shows the slide by itself in perspective, on a larger scale than that of FIG. 1, FIG. 4 is a section along the line IV—IV of FIG. 1, in closed position, FIG. 5 is a corresponding cross section in dispensing position, FIG. 6 is a cross section along the line VI—VI of FIG. 4, FIG. 7 is a cross section along the line VII—VII of FIG. 6, FIG. 8 is a front view of the container of the second embodiment, FIG. 9 is a top view thereof, FIG. 10 shows the slide by itself in perspective on a larger scale than that of FIG. 8, FIG. 11 is a cross section along the line XI—XI of FIG. 8, in the closed position of the container, FIG. 12 is a corresponding cross section in dispensing position, and FIG. 13 is a cross section along the line XIII—XIII of FIG. 11.

A container housing 1 (herein simply called container), the major part of the inside thereof forming the storage chamber V, is of oval cross section in accordance with FIG. 1 and can be closed by a lid 2 of suitable development. The container is higher than it is wide. Its contents consists of disk-shaped material such as, for instance, tablets 3. They may have a strong bulge shape or a lens shape (see FIG. 6).

The individual dispensing of these tablets is effected by means of a slide 4. The latter extends upwardly to form an actuating button 5. The actuating button 5 is also of oval cross section and passes through a correspondingly shaped opening 6 in the top 2' of the lid 2.

The actuating button 5 is developed on the slide 4 and hollowed in order to save material; the edge thereof which faces the inside of the container forms a stop edge 7 which comes against the top 2'. The stop limitation in the opposite direction is formed by a niche 8, open on top, in one side wall S1 of the container, into which niche 8 the slide actuating button 5 partially extends. The stop-limited inward position of the slide 4 against the bottom step of this notch can be noted from FIG. 5. The displacement for dispensing is effected against spring biasing. A corresponding slide spring 9 is developed on the slide 4. It consists of two divergent tabs which rest against the bottom surface 10 which is deep-drawn in the transverse central region of the container 1.

Beyond the guide on the side of the lid, the slide 4 is supported over its entire length in a rail guide 11 which is perpendicular to the bottom surface 10 of the container so that the relatively long slide is prevented from bending even when the lid 2 is removed for refilling. It has been found that for suitable guidance an undercut (see FIG. 7) on one side is in itself sufficient for certain structural heights.

The lower section of the slide 4 which forms the tablet sluice gate is developed in the form of a key bit, a side wall 12 extending from the relatively flat section 4' which is guided in the rail guide 11. The edge 12' of this side wall extends up to directly in front of the inside of the other container side wall S2. The slide 4, in the basic position of the slide (FIGS. 4 and 6), assumes the position in which its side wall 12 extends projecting beyond the inner throat K of two container bottom walls 13 which are inclined relative to each other in V-shape. The corresponding projection corresponds to the stroke of the slide. The upper edge, 12" of the side wall 12 extends parallel to the lid 2'. The section which extends beyond the throat K holds back the filling material which lies on the left-hand container bottom wall 13; only the material lying on the right-hand container bottom wall 13 and therefore on the other side of the side wall 12 which forms practically a partition wall, is directly incorporated in the dispensing path. On this side of the side wall 12, the container bottom wall 13 terminates at a distance spaced from the side wall 12 which corresponds to the thickness of the tablet 3. On that side the side wall 12 forms a side rib 14. The upper side thereof forms the rolling ramp 14' for the tablets 3 which collect thereon, standing on their edge (CF. FIGS. 3 and 4). This rolling ramp 14' has a course directed downward to the window-shaped tablet drop-out opening 15 formed in the slide 4. In the closed position (FIG. 4) of the container, the tablet drop-out opening 15 is closed by the container side wall S1 which extends in front of it. Only upon operation of the push button 5 is the drip-out opening 15 displaced into the region of the tablet drop-out opening 16 formed in the side wall 31 of the container so that the frontmost tablet 3' drops out.

The end of the slide 4 which is developed in the form of a key bit extends in this connection into a narrow shaft 17 which extends to the base surface of the container 1. The vertical sections which directly adjoin the container, bottom walls 13 and define the narrow guide shaft and form the deep-drawn closed bottom surface 10 are designated 13'.

The division finger 18 extends from the right-hand section 13' of the container bottom wall 13. The division finger lies in the direction of movement of the slide and intersects the side rib 14 which has a passage opening 19 corresponding to the cross section of the rib. This passage opening, as can be noted from FIG. 3, is widened somewhat in the downward direction. The upper end edge has a transverse rounding. With the lowering of the rolling ramp 14' the tablets, arranged in a row in the dispensing direction, are slightly displaced as a result of the relative movement between the side wall 12 on the one hand and the right-hand shaft-forming section 13' on the other hand and so loosened that no shingle-like jamming edge overlap of the tablets is possible. The division finger 18 which enters between the next to the last tablet and the tablet 3' on the dispensing side results in further gentle loosening and lifts the next to the last tablet and the rest of the contents away from the tablet 3' which is ready to be dispensed. Above the stationary division finger 18 the slide forms a deflection shoulder 20 which extends parallel above and respectively towards the rolling ramp 14' and passes, approximately at the height of the division finger 18, via a rounding into a backward-cut shoulder section which, on the inside of the slide, continues into the latter. The parallel edge is aligned with the upper edge of the slide drop-out opening 15. The deflection shoulder 20 is formed on the slide, as is the side rib 14. The deflection shoulder 20 together with the section of the side rib lying to the right of the passage opening 19 forms a type of a direction-determining funnel. After release of the push button 5 the slide moves back again into the basic blocking position shown in FIG. 4.

The container 1 may also be of round cross section. It is furthermore possible to arrange the slide not only in the transverse central plane of the oval shape of the container but also in the longer axis of the oval shape, in which case the tablet drop-out opening would then lie in the rounded section of the container wall.

The lower edge 16' of the tablet drop-out opening is developed obliquely, corresponding to the downward descending direction of the rolling ramp 14'.

The container 1 in accordance with the second embodiment (FIGS. 8 to 13) is of substantially box-shaped development and of rectangular cross-sectional shape. Otherwise the same construction as described above is present based on the fundamental principle; the reference numbers have been employed accordingly.

The slide is now of frame shape and passes at the top into an actuating push button 5 which formed as a cap-shaped part closes off in lid fashion the entire inside cross section of the storage chamber V. The hollow of the cap is directed towards the inside of the container. The top of the cap has a centrally located actuating trough 5' approximately of the size of the tip of one's finger.

In cases in which the actuating push button 5 is produced as a separate structural part, it merely lies loosely on the upper end surface 24" of the slide frame arm 24' present there. The outer edge of the cap-shaped actuating push button 5 is interrupted so that the cap can be introduced unimpeded into the container. The push button is connected by detent coordination with the container.

For this purpose detent ribs 25 which protrude inwards extend from two opposite container walls. They are formed on the container and engage into detent depressions or window-shaped openings 22 of the actuating push button 5. The detent ribs 21 form a run-on bevel 21' in the direction of insertion. This bevel is run-over upon assembling by the lower edge of the window arm 23, the upper edge of which then springs under the detent rib 21. The cap wall is partially cut back (see FIG. 13) so that only tabs providing the detent means and the frame side support are still present.

The window-shaped opening 22 takes into consideration in its height the required dispensing stroke of the slide 4.

The stop-limited depressed position of the slide 4 or actuating button 5 can be noted from FIG. 12. This displacement for dispensing is effected in this case also against spring biasing. The slide spring 9 consists of two tabs which are rooted in the region of the lower frame corners of the slide 4 and are directed extending arcuately towards each other. By lateral displacement they can move past each other upon actuation of the push button 5.

The vertical arms 24 of the frameshaped slide 4 extend in guides formed by ledges 25. The ledges 25 are developed on the corresponding wall sections.

The portion of the slide 4 which forms the tablet sluice gate is developed as side wall 12 extending from vertical arm 24 to opposite vertical arm 24. Structurally there is therefore a somewhat more widely developed bottom-side slide frame arm.

The upper edge 12'' of the side wall 12 extends horizontally over half its length and then passes into a descending zone 12'''.

Adjacent the division finger 18 there is a second finger 26 which is relatively displaced shifted somewhat in the direction towards the other container side wall S2. The side rib 14 correspondingly forms a second passage opening 27. The distance between the fingers 18 and 26 is smaller than the diameter of the tablets. The fingers terminate at the same height. The ramp 14' extends at an acute angle thereto.

The second finger 26, which extends over the rolling ramp 14 which descends as a result of the actuation of the push button, has less a division function than the function of assuring additional loosening of the tablets in the region near the dispensing. This second finger 26, in addition to this function also serves for the additional guidance of the slide 4 close to the bottom. This result is achieved structurally in the manner that a downwardly directed tab 28 extends from one edge, located on the drop-out side, of the passage opening 19 for the first division finger which lies closest to the deflection shoulder 20. This tab rests substantially flat against the corresponding side flank of the division finger 18. From the passage opening 27 for the second finger 26 which is remote from the deflection shoulder 20, there extends a second tab 29 which is directed at an acute angle relative to the first tab 28. The tab 29 enters into the space 30 between division finger 18 and finger 26. As a result of the inclined position of the tab 29, its free end 29' comes in contact with the side flank there of the finger 26. The diagonal edge 29'' of the tab moves over the other side flank of the division finger 18.

After release of the push button 5, the slide 4 comes back into the basic blocking position shown in FIG. 11 by means of the spring 9.

I claim:

1. In a container for the dispensing of tablets one by one in which a tablet drop-out opening is formed in a container housing wall of the container below a storage chamber therein having a bottom opening, a spring-biased slide, having a depressed position and a non-depressed position, moveably disposed in front of the vicinity of said drop-out opening and releasing at each time one individual tablet so that one tablet at a time can drop out of the drop-out opening, said slide continuing towards the outside of the container in the form of an actuating button, said slide cooperating with a division finger, said division finger in the depressed position of the slide blocking the path between the bottom opening of the storage chamber and the tablet drop-out opening, the improvement comprising two bottom walls of the container housing are inclined in a V-shape relative to each other defining an inner throat therebetween constituting the bottom opening of the storage chamber, said bottom walls of the container housing define a stationary bottom of said storage chamber, said slide is movable relative to said bottom walls of the container housing and with respect to the tablets in the storage chamber and is formed with another tablet drop-out opening, said slide is formed in the vicinity of the inner throat with a side wall, said side wall in the non-depressed position of said slide projects over said throat into said storage chamber so as to constitute a partition wall isolating, one one side thereof, the tablets in the storage chamber from said throat, a side rib mounted on the other side of said slide and directed transversely relative to the inclination of said bottom walls and downwardly toward said another tablet drop-out opening of the slide, said side rib being formed with a passage opening means for receiving said division finger, said slide is formed on said other side thereof with a deflection shoulder opposite to said division finger, said deflection shoulder extends approximately to said another tablet drop-out opening.

2. The container according to claim 1, wherein said side wall has an upper edge disposed at the height of said throat when said slide is in the depressed position.

3. The container according to claim 1, further comprising a container lid disposed on the wall of the container and formed with an opening, the actuating button of the slide extends out of said opening in said container lid displaceably relative thereto, stop means on said container wall and said actuating button for limiting the displacement of said actuating button, and the tablet drop-out opening is formed in the wall of the container, said wall constitutes a side wall of the container.

4. The container according to claim 3, further comprising a rail guide means formed on said side wall of the container for moveably guiding said slide along the entire length of said slide during movement from the non-depressed position to the depressed position, said division finger extends from a section of one of said bottom walls, said section is bent off in the direction of movement of said slide.

5. The container according to claim 1, further comprising spring means for biasing said slide into the non-depressed position, said spring means is arranged in a region below said bottom walls.

6. The container according to claim 1, further comprising another finger adjacent the division finger disposed on a side thereof facing away from said deflection shoulder, said side rib is formed with another passage opening means for receiving said another finger extending therethrough.

7. The container according to claim 6, wherein said side rib is formed with a downwardly directed first tab extending from an edge of said first-mentioned passage opening means for receiving said division finger, said edge being located closest to said deflection shoulder, said tab lies against one side flank of said division finger, said side rib is formed with a second tab directed at an acute angle relative to said first tab and extending from said another passage opening means for receiving said another finger, the latter being remote from said deflection shoulder, said second tab enters into a space between said division finger and said another finger and has a free end lying against one side flank of said another finger.

8. The container according to claim 6, wherein
said slide is formed as a frame having frame corners at a lower end thereof,
two spring means for biasing said slide into the non-depressed position act in a region of said frame corners and extend in arcuate shape in different planes towards each other.

9. The container according to claim 8, wherein
an outer end of said slide is formed as said actuating button constituting an actuating push button which fills up an entire upper inside cross-section of the storage chamber,
detent engagement means for holding said actuating push button on an inner wall of the storage chamber, said inner wall constituting an inside of the wall of the container.

10. The container according to claim 9, wherein
said slide has a frame arm at an upper end,
said actuating push button lies loosely on an upper end surface of said frame arm.

11. The container according to claim 1, including
movement path means for guiding movement of said tablets from said storage chamber to said tablet drop-out opening, wherein
said tablets are lined up one by one in order, said movement path means including an inclined portion wherein tablets descend toward said tablet drop-out opening, the entire inclined portion of said movement path means being defined by said rib and said inner throat and the entire inclined portion of said movement path being directed in a straight line toward said drop-out opening when said slide is in said depressed position.

12. The container according to claim 1, wherein
said division finger extends from a bottom surface of said container housing into the inner throat, and is integral with said bottom surface.

13. The container according to claim 1, wherein
said bottom walls extend from opposite side wall portions of said container housing wall and forming a funnel approach said drop-out opening.

14. The container according to claim 1, wherein
a longitudinally extending upper portion of said side wall moves longitudinally into said storage chamber with an orientation substantially bisecting the V-shape of said bottom walls upon movement of said slide from the depressed position into the non-depressed position.

15. The container according to claim 1, wherein
a portion of said side wall projecting over said throat into said storage chamber in the non-depressed position has substantially one half of the height of said side wall and is substantially smaller in height than the height of said storage container.

16. The container according to claim 15, wherein
the height of the portion of said side wall projecting over said throat into said storage chamber in the non-depressed position is smaller than the height of said bottom walls.

17. The container according to claim 1, wherein
said side wall is entirely recessed in said inner throat when said slide is in said depressed position.

18. The container according to claim 1, wherein
said storage chamber is immovable with respect to said container housing.

* * * * *